US007905111B2

(12) United States Patent
Saltz

(10) Patent No.: US 7,905,111 B2
(45) Date of Patent: Mar. 15, 2011

(54) BRACELET

(75) Inventor: Marcella Saltz, North Hollywood, CA (US)

(73) Assignee: The Saltz Corporation, North Hollywood, CA (US)

( * ) Notice: Subject to any disclaimer, the term of this patent is extended or adjusted under 35 U.S.C. 154(b) by 0 days.

(21) Appl. No.: 10/639,506

(22) Filed: Aug. 13, 2003

(65) Prior Publication Data

US 2005/0034481 A1 Feb. 17, 2005

(51) Int. Cl.
*A44C 5/12* (2006.01)
*A61M 35/00* (2006.01)

(52) U.S. Cl. ..... 63/3; 63/11; 63/34; 604/289

(58) Field of Classification Search ..... 63/3–3.2, 63/33, 1.11–1.18, 15–15.9, 40
See application file for complete search history.

(56) References Cited

U.S. PATENT DOCUMENTS

| | | | | | |
|---|---|---|---|---|---|
| 204,502 | A | * | 6/1878 | Osselin | 63/15 |
| 1,051,903 | A | * | 2/1913 | Mason | 63/3 |
| 2,712,173 | A | * | 7/1955 | Denner | 29/896.412 |
| 3,908,356 | A | * | 9/1975 | Williams | 368/280 |
| 4,781,705 | A | * | 11/1988 | Shepherd et al. | 604/289 |
| 5,535,603 | A | * | 7/1996 | Hayakawa | 63/3 |
| 5,586,390 | A | * | 12/1996 | Barr | 29/896.411 |
| 5,701,765 | A | * | 12/1997 | Cerqua | 63/15.4 |
| 5,901,379 | A | * | 5/1999 | Hirata | 2/170 |
| 6,026,572 | A | * | 2/2000 | Caldaro | 29/896.412 |
| 6,062,045 | A | * | 5/2000 | West | 63/15 |

FOREIGN PATENT DOCUMENTS

| | | | |
|---|---|---|---|
| CH | 661 642 | A5 * | 8/1987 |
| JP | 2002345514 | A * | 12/2002 |
| WO | WO 93/25110 | * | 12/1993 |

* cited by examiner

*Primary Examiner* — Jack W. Lavinder
(74) *Attorney, Agent, or Firm* — Breiner & Breiner, LLC

(57) ABSTRACT

The present invention is a bracelet having an inner layer and an outer later. The inner layer of the bracelet is copper and the outer layer is another metal, preferably a precious metal such as sterling silver or gold, platinum or titanium. However, any suitable material may be used for the outer layer. Since copper can be absorbed through the skin, a wearer receives the medicinal benefits of copper while wearing a bracelet that is a fine piece of jewelry. In a preferred embodiment, the copper inner layer is a comfort fit layer.

11 Claims, 2 Drawing Sheets

BRACELET

FIELD OF INVENTION

This invention relates to a bracelet with an inner layer of copper which provides a wearer with the important health benefits of copper while the bracelet is aesthetically appealing.

BACKGROUND OF INVENTION

For centuries people have adorned themselves with various types of jewelry, including rings, necklaces, bracelets, earrings and tiaras. Jewelry is usually made from various types of precious and non-precious metals and gemstones. Typical gemstones used in jewelry designs have included diamonds, emeralds, sapphires, rubies, pearls and opals. Typical precious metals used in jewelry designs have included gold, silver and platinum. However, other types of metals are being used, such as copper and copper with mixed metals.

Copper is a natural, environmentally friendly element that has been used for centuries because of its physical properties. These properties include being malleable and ductile, excellent electrical conductor, excellent alloying characteristics, non-magnetic, essential nutrient to life, resistant to corrosion, machinable, formable, excellent heat transfer characteristics, durable and recyclable.

Uses of copper have been traced back as far as 10,000 years ago in western Asia. Historically, copper has been used for plumbing systems, cooking instruments, ornaments, treating infections and sterilizing water. Copper also played a major role in launching the Industrial Revolution due to its excellent electrical conducting and heat transfer characteristics.

Copper is essential to all living things and continues to play an important role in modern technology. Specifically, copper continues to be used in plumbing systems, cookware, industrial and architectural applications, jewelry and for various health related applications.

In the health context, copper has been used for its anti-pathogen properties to help guard against infections. For example, copper plumbing can help preserve the purity of drinking water because its antimicrobial effects can inhibit water-borne microorganisms, such as bacteria, viruses, algae and parasites. Additionally, since copper plumbing is non-porous, it can prevent petrochemicals, insecticides, organic contaminants and other toxins from absorbing into the pipes and polluting the water supply.

Cures and remedies for common ailments have also been sought throughout the years and continues today. Copper is needed for good health. Copper is necessary for the growth, development and maintenance of bones, tissues, and organs. Copper is also involved in the formation of red blood cells, absorption and utilization of iron, and synthesis and release of essential proteins and enzymes. As such, copper has been used as a natural medicinal remedy. Since the human body cannot make copper, it must be obtained from other sources, including a balanced diet or supplements.

Copper bracelets are known in the prior art. However, these bracelets are not fine jewelry and are generally not aesthetically appealing. Specifically, bracelets are made using low grade copper and copper and mixed metals as jewelry and which do not provide any meaningful health benefits. They are artistic in nature. Copper bracelets providing health benefits are also known in the art, including those offered by Sabona of London. These latter bracelets are made of pure copper and are copper alone or with a gold or silver electroplate finish over the copper bracelet.

OBJECTS AND SUMMARY OF THE INVENTION

The present invention is a bracelet inlaid or channeled with copper. The bracelet is fine jewelry and provides a wearer with the medicinal benefits of copper. The term "bracelet" is used herein in its broad sense to include any item generally c-shaped which is worn on the human body, including traditional wrist bracelets and bracelets which function as a band for a watch or other items.

Since copper can be absorbed through the skin, the inner layer of the bracelet is copper and the outer layer is another metal, preferably a precious metal such as sterling silver and 14 karat and 18 karat gold. However, any suitable precious or non-precious metal or material may be used for the outer layer such as platinum, titanium, stainless steel or on occasion rubber. In a preferred embodiment, the channeled copper inner layer is a comfort fit layer, e.g., a special formed shape of copper which provides a comfortable fit on the wearer.

A primary object of the present invention is to provide a wearer with the health benefits of copper in the form of an aesthetically appealing bracelet.

Another primary object of the invention is to provide a fine piece of jewelry which also provides the medicinal benefits of a plain copper bracelet.

Another primary object of the invention is to provide a fine piece of jewelry which includes a bracelet having a channeled copper inlay.

Another primary object of the invention is to provide a simple, efficient and inexpensive method of manufacturing a fine piece of jewelry which includes a precious metal and a channeled copper inlay which copper inlay provides medicinal benefits to the wearer.

Another object of the present invention is to provide a copper inlay bracelet with a comfort fit inner layer.

BRIEF DESCRIPTION OF THE DRAWINGS

Referring now to the drawings.

DETAILED DESCRIPTION OF THE PREFERRED EMBODIMENTS

The present invention includes a bracelet 20 having an overall aesthetic appeal while providing a wearer with the health benefits of copper. Referring to FIGS. 1-7, the bracelet 20 is preferably C-shaped and has an inner metal layer 26 and an outer metal layer 22. In a preferred embodiment, the inner layer 26 of the bracelet 20 is pure copper and the outer layer 22 of the bracelet 20 is another metal, preferably a precious metal such as sterling silver or 14 karat and 18 karat gold. However, any suitable precious or non-precious metals or other material may be used for the outer layer 22 of the bracelet 20, including platinum, titanium, stainless steel or the like. Similarly, in the preferred embodiment, the outer metal layer 22 is a fine piece of jewelry of original design. An important aspect of the invention includes having a fine piece of jewelry which provides the medicinal benefits of copper. It is understood, however, that non-original works of jewelry may also be used with the inner layer of channeled copper as disclosed herein.

The copper inner layer 26 of the bracelet 20 is close to a wearer's skin, allowing the copper from the inner layer 26 to be absorbed into a wearer's body through the skin. In a preferred embodiment, the copper in the copper inner layer 26 of the bracelet 20 is CDA 102 copper 99.9%. However, any suitable copper may be used.

Figure 1:
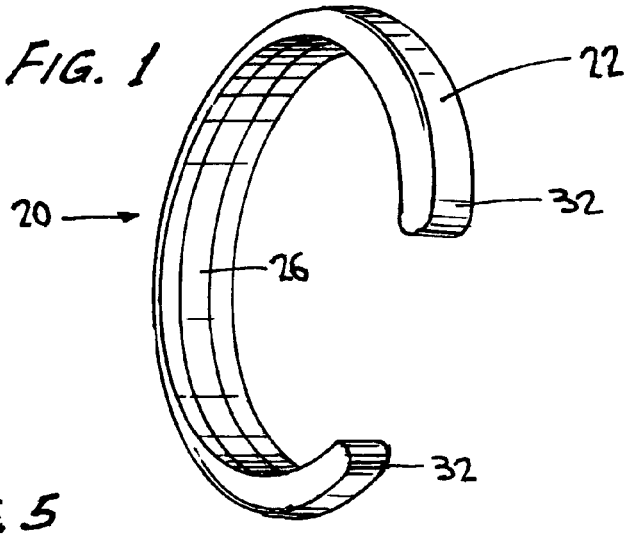
FIG. 1 illustrates a perspective view of the bracelet of the present invention.
Figure 5:
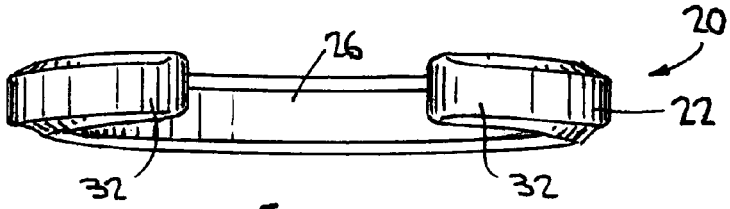
FIG. 5 illustrates a bottom plan view of the bracelet of FIG. 1.
Figure 2:
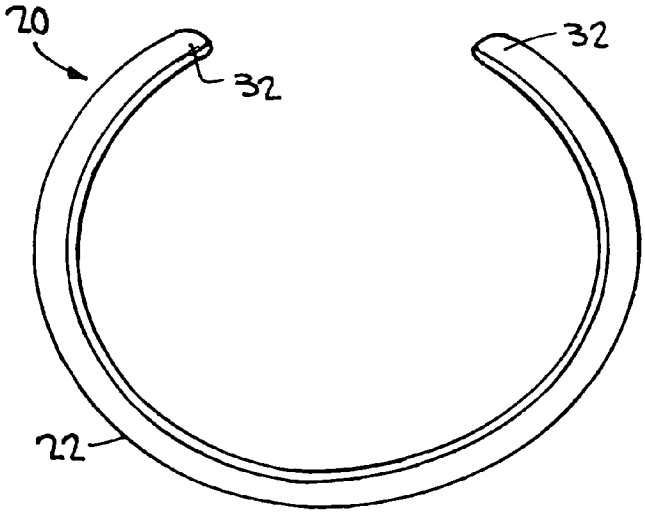
FIG. 2 illustrates a side view of the bracelet of FIG. 1.
Figure 3:
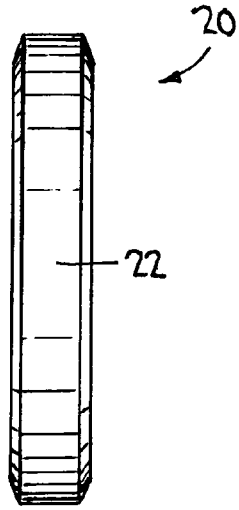
FIG. 3 illustrates an end view of the bracelet of FIG. 1.
Figure 4:
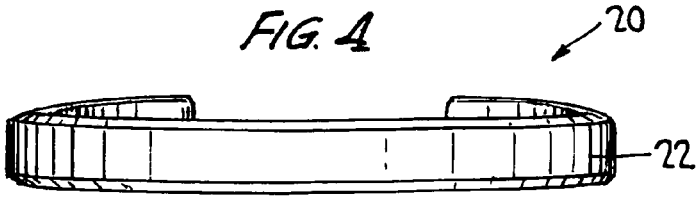
FIG. 4 illustrates a top plan view of the bracelet of FIG. 1.
Figure 6:
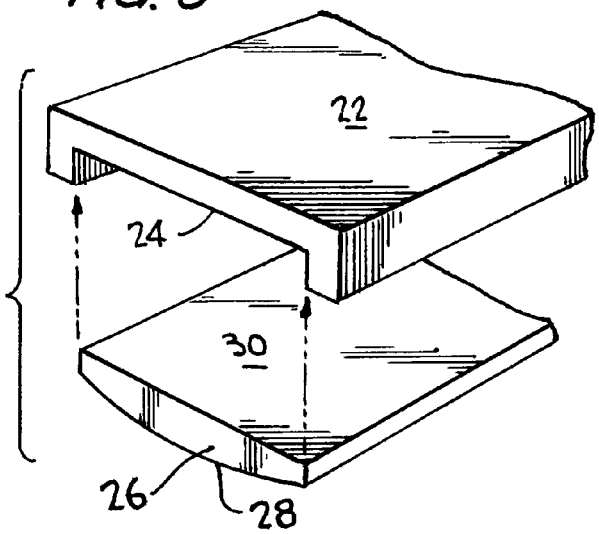
FIG. 6 illustrates a partial exploded view of the layers of the bracelet of FIG. 1.
Figure 7:
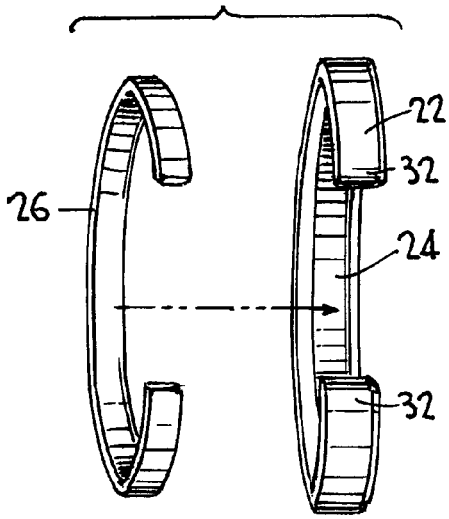
FIG. 7 illustrates an exploded view of the layers of the bracelet of FIG. 1.

In a preferred embodiment, the copper inner layer 26 is a comfort fit layer, as shown in FIG. 6. In a preferred embodiment where the copper inner layer 26 is a comfort fit, the copper inner layer 26 has a curved side 28 and a flat side 30. This curved side 28 comes in contact with a wearer's skin. This comfort fit copper inner layer 26 provides a smooth, curved surface to contact the wearer's skin, thereby providing a bracelet 20 that is extremely comfortable to wear.

In a preferred embodiment, the outer layer 22 is preferably sterling silver or 14 karat or 18 karat gold. However, any suitable precious or non-precious metal may be used such as, but not limited to, platinum, titanium, stainless steel or the like. As shown, for example, in FIG. 6, the underside of outer layer 22 is preferably channel shaped or U-shaped. The outer layer 22 is formed such that the flat side 30 of the copper inner layer 26 fits into the channel 24 of the outer layer 22 of the bracelet 20. Preferably, channel 24 will secure inner layer 26 in place as discussed in greater detail hereafter.

The copper inner layer 26 may be held in place in the channel 24 of the outer layer 22 of the bracelet 20 by means of the channel 24 by providing a snug fit on having other suitable securing means. However, the presently preferred method of securing the copper inner layer 26 in the channel 24 of the outer layer 22 is by the channel and first using an adhesive and then soldering the end of the inner copper layer to the ends of the outer metal layer. The adhesive and solder provide additional assurance that the inner metal layer will not become detached from the outer metal layer.

Figure 8:
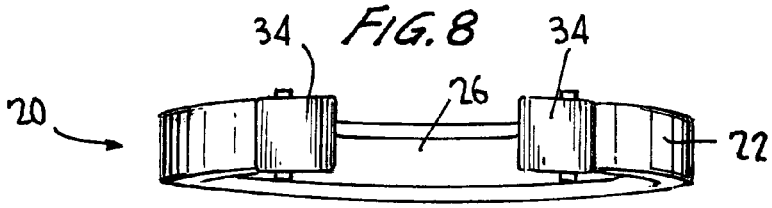
FIG. 8 illustrates a bottom plan view of another embodiment of the bracelet of FIG. 1.
Figure 9:
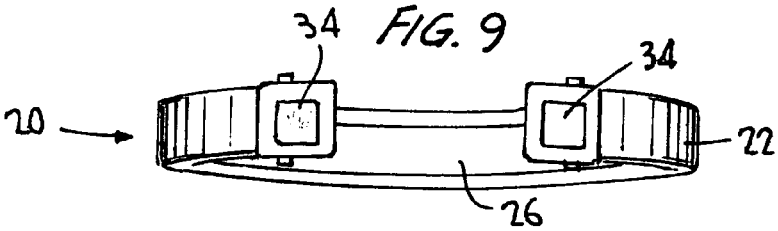
FIG. 9 illustrates a bottom plan view of another embodiment of the bracelet of FIG. 1.
Figure 10:
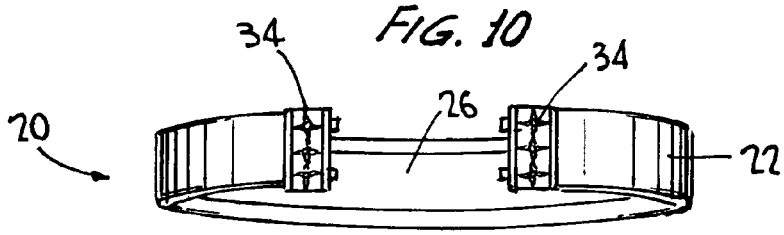
FIG. 10 illustrates a bottom plan view of another embodiment of the bracelet of FIG. 1.

As described above, the bracelet 20 of the present invention is preferably C-shaped. The ends 32 of the C-shaped bracelet 20 may be plain (as shown in FIGS. 1-5) or may have end caps 34 (as shown, for example, in FIGS. 8-10). Any suitable end cap 34 may be used to provide additional aesthetic appeal to the bracelet 20 of the present invention. Additionally, various types of precious and semi-precious gemstones or decorative features may be added to the bracelet 20, especially to the outer layer 22 of the bracelet 20 to provide additional aesthetic appeal. The bracelet 20 of the present invention may be worn by any person. While enjoying the aesthetic appeal of the bracelet 20, a wearer also receives the health benefits of the copper inner layer 26 when it comes in contact with and is absorbed through a wearer's skin. For example, the copper inner layer 26 provides a wearer with a continuous flow of the elemental copper which aids in relieving joint inflamation and keeping joint inflamation down. As such, the bracelet 20 of the present invention is excellent for people with arthritis, joint inflamation and problems which may be associated with physical stress and pressure on joints, such as, but not limited to, that associated with athletes in training. The bracelet 20 is also beneficial as a preventative method of relieving joint inflamation or health problems associated with a lack of copper in the body. Therefore, any wearer would benefit from the copper inner layer 26 while enjoying the aesthetic appeal of a fine piece of jewelry.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A bracelet comprising:

an outer layer having a channel formed in an underside of said outer layer, wherein said channel has straight-edge flange-free side walls; and an inner layer having a first side and a second side, wherein said inner layer is copper, wherein said first side of said inner layer fits into said channel of said outer layer and said second side of said inner layer is a substantially outwardly facing side, wherein said straight-edge flange-free side walls and said inner layer are constructed and arranged to form a smooth continuous surface from a first straight-edge flange-free side wall of said channel, over said second side of said inner layer and to a second straight-edge flange-free side wall of said channel, wherein said outer layer and said inner layer of said bracelet are substantially C-shaped.

2. The bracelet according to claim 1, wherein said bracelet is substantially C-shaped and wherein said bracelet has a first end and a second end.

3. The bracelet according to claim 2, further comprising a first end cap and a second end cap, wherein said first end cap is operatively positioned at said first end of said bracelet and wherein said second end cap is operatively positioned at said second end of said bracelet.

4. The bracelet according to claim 1, wherein said inner layer is secured to said outer layer by said channel.

5. The bracelet according to claim 4, wherein said inner layer is further secured to said outer layer by solder and/or an adhesive.

6. The bracelet according to claim 4, wherein said first side of said inner layer is a flat side, said flat side of said inner layer being inserted into said channel of said outer layer and said outwardly facing side of said inner layer being comfort fit such as to provide comfort to a wearer of said bracelet.

7. The bracelet according to claim 1, wherein said first side of said inner layer is a flat side, said flat side of said inner layer being inserted into said channel of said outer layer and said outwardly facing side of said inner layer being comfort fit such as to provide comfort to a wearer of said bracelet.

8. The bracelet according to claim 7, wherein said inner layer and said outer layer are joined by solder and/or an adhesive.

9. The bracelet according to claim 8, further comprising a first end cap and a second end cap, wherein said first end cap is operatively positioned at a first end of said bracelet and wherein said second end cap is operatively positioned at a second end of said bracelet.

10. The bracelet according to claim 1, wherein said inner layer and said outer layer are secured by solder and/or an adhesive.

11. The bracelet according to claim 1, wherein said outer layer is selected from the group consisting of sterling silver, platinum, gold, titanium, stainless steel and rubber.

* * * * *